US005820985A

United States Patent [19]

Chow et al.

[11] Patent Number: 5,820,985

[45] Date of Patent: Oct. 13, 1998

[54] PDC CUTTERS WITH IMPROVED TOUGHNESS

[75] Inventors: Jacob Chow, Salt Lake City; Ralph M. Horton, Murray; Redd H. Smith; Gordon A. Tibbitts, both of Salt Lake City, all of Utah

[73] Assignee: Baker Hughes Incorporated, Houston, Tex.

[21] Appl. No.: 569,828

[22] Filed: Dec. 7, 1995

[51] Int. Cl.[6] ..... B24D 11/00

[52] U.S. Cl. ..... 428/408; 51/307; 428/457; 428/465; 428/698; 428/704

[58] Field of Search ..... 428/408, 457, 428/469, 698, 704; 51/295, 307

[56] References Cited

U.S. PATENT DOCUMENTS

| | | | |
|---|---|---|---|
| 4,403,015 | 9/1983 | Nakai et al. | 428/698 |
| 4,690,691 | 9/1987 | Komanduri | 51/293 |
| 4,961,780 | 10/1990 | Pennington, Jr. . | |
| 4,988,421 | 1/1991 | Drawl et al. . | |
| 5,011,514 | 4/1991 | Cho et al. . | |
| 5,011,515 | 4/1991 | Frushour . | |
| 5,022,894 | 6/1991 | Vagarali et al. . | |
| 5,037,704 | 8/1991 | Nakai et al. | 428/408 |
| 5,111,895 | 5/1992 | Griffin . | |
| 5,116,416 | 5/1992 | Knox et al. . | |
| 5,151,107 | 9/1992 | Cho et al. . | |
| 5,176,720 | 1/1993 | Martell et al. . | |

FOREIGN PATENT DOCUMENTS

| | | |
|---|---|---|
| 0246789 | 11/1987 | European Pat. Off. . |

*Primary Examiner*—Archene Turner
*Attorney, Agent, or Firm*—Trask, Britt & Rossa

[57] ABSTRACT

A polycrystalline diamond layer attached to a cemented metal carbide structure used as a cutter wherein the cutter has improved toughness or fracture resistance during use through the inclusion of boron, beryllium or the like therein.

13 Claims, 2 Drawing Sheets

PDC CUTTERS WITH IMPROVED TOUGHNESS

BACKGROUND OF THE INVENTION

1. Field of the Invention

The present invention relates to a polycrystalline diamond composite compact for use in drilling operations which require high wear resistance of a diamond surface. More specifically, the present invention relates to a polycrystalline diamond layer attached to a cemented metal carbide structure used as a cutter in a drill bit for drilling operations wherein the cutter has improved toughness or fracture resistance, during use.

2. State of the Art

Polycrystalline diamond tools suitable for use in rock drilling operations are well known. Typically, the polycrystalline diamond cutters used on such tools are composite compacts comprising a polycrystalline diamond layer and a cemented carbide support structure. Typically, the carbide support structure comprises tungsten carbide containing cobalt metal as the cementing constituent. The cobalt contained in the carbide support structure functions as the bonding metal for the carbide, as a sintering aid for consolidating the diamond particles into a solid attached diamond layer, and to bond the diamond layer to the carbide support. Care must be exercised regarding the amount of cobalt used as an excessive amount of cobalt infiltrated from the carbide support structure into the diamond layer leaves an excessive amount of cobalt among the diamond particles thereby affecting the mechanical properties, possibly causing less than optimal abrasion resistance of the diamond layer. Also, the physical and mechanical properties of the cemented carbide support structure near the diamond/carbide interface are affected as a result of the cobalt depletion from the carbide support. Typically, the cobalt depletion of the carbide support structure adjacent to the interface results in reduced mechanical properties in a critical area of the diamond tungsten carbide cutter.

Various methods are used to control the cobalt infiltration into the diamond to prevent excessive infiltration into such layer and the attendant cobalt depletion of the carbide support structure. Typically prior art diamond cutters are described in U.S. Pat. Nos. 4,988,421; 5,011,514; 5,011,515; 5,022,894; 5,111,895; 5,151,107; and 5,176,720 as well as European Patent Application 0,246,789.

Also, attempts have been made to increase the hardness of cemented carbide bodies, which bodies include a tungsten backing of the polycrystalline diamond compact, are made by sintering pressed carbide powders to provide cutting implements having the ability to hold a sharper edge or longer life. Such cemented carbide bodies typically are comprised of a mixture of tungsten carbide and cobalt. Typically, in forming such bodies a trade-off occurs between brittleness and hardness. The harder the body is the better the body holds a cutting edge; however, the more brittle the body.

One attempt to avoid the increased brittleness while improving hardness has been to produce a thin surface coating or layer on the carbide body containing boron by diffusing boron into the surface of the cemented carbide body. However, as the thin coating is worn away the improved properties of hardness as well as other features are lost. Another attempt has been made to improve the properties of a cemented carbide body made by sintering pressed carbide powders in the presence of boron containing material to diffuse the boron to a greater depth in the cemented carbide body. Such cemented carbide bodies are described in U.S. Pat. Nos. 4,961,780 and 5,116,416. These types of cemented carbide bodies including boron show improved fracture toughness over bodies which contain no boron.

SUMMARY OF THE INVENTION

The present invention relates to a polycrystalline diamond layer attached to a cemented metal carbide support structure used as a cutter in a drill bit for drilling operations wherein the cutter has improved toughness or fracture resistance during use. The present invention is directed to a cutter comprising a polycrystalline diamond layer and a cemented support structure including tungsten carbide, boron and cobalt.

DETAILED DESCRIPTION OF THE ILLUSTRATED EMBODIMENT

Figure 1:
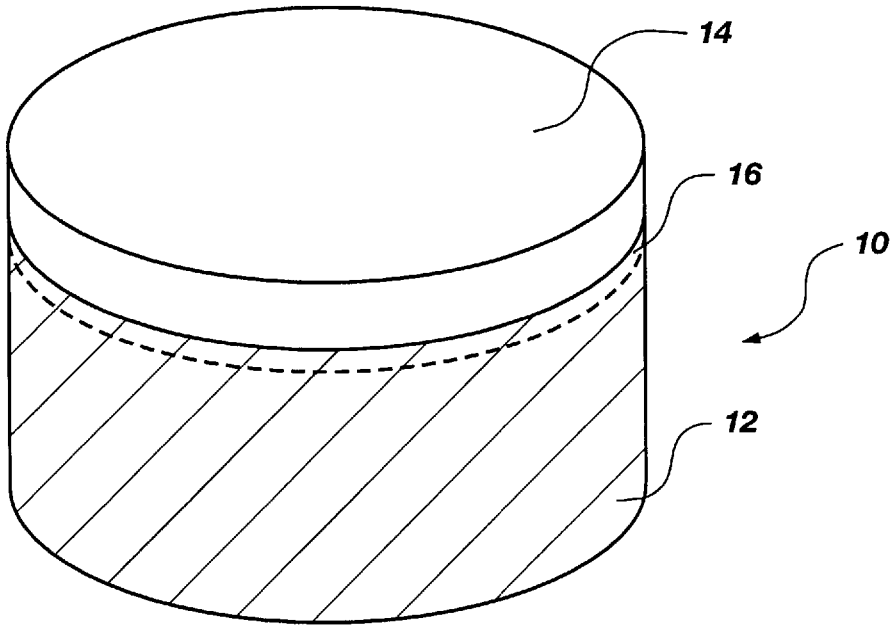
FIG. 1 illustrates a free-standing typical cutting element of the present invention.

The present invention provides a method for making backed abrasive compacts having an improved toughness or fracture resistance during use. Referring to drawing FIG. 1, a composite compact 10 comprising a cemented carbide support structure 12 and a polycrystalline diamond table or layer 14 is shown.

The composite compacts for use in rock drilling and machining are well known in the art, such as described in U.S. Pat. No. Re. 32,380. As described, the composed compact comprise a polycrystalline diamond layer wherein the diamond layer is bonded by the use of cobalt to the cemented carbide support material which is considerably larger in volume than that of the volume of the polycrystalline diamond layer. Typically, the carbide support structure is tungsten carbide containing cobalt metal as the cementing constituent.

As previously stated, the cobalt contained in the carbide support structure makes itself available to function both as the metal bond for sintering the tungsten carbide, a diamond sintering aid to facilitate sintering of the diamond powder, and to bond the sintered diamond layer to the carbide support.

While it is possible to limit or control the cobalt depletion from the carbide support through a variety of manners, some cobalt typically infiltrates into the polycrystalline diamond layer of the composite compact leaving a depleted zone in the adjacent carbide support. The depleted zone 16 is shown in the carbide support 12 in drawing FIG. 1.

As a result of the cobalt being present in the interstices between the diamond particles, the diamond layer 14 degrades at a lower temperature. Also, a small region between the diamond layer 14 and the bulk of the carbide support 12 has reduced mechanical properties, such as fracture toughness, as cobalt has been depleted from the zone 16 of the carbide support 12. This makes the zone 16 more susceptible to crack formation and propagation.

The present invention utilizes boron to control the fracture toughness properties of the zone 16 from which cobalt is depleted during the diamond layer sintering. The polycrystalline diamond compact has improved toughness or fracture resistance as a result of the inclusion of boron in the zone 16 of the support 12.

The improved toughness or fracture resistance of the compact is significantly improved in those compacts using lower percentages of cobalt in the carbide support structure. The cobalt content of the depleted zone 16 is such that a relatively large improvement of toughness occurs.

One manner of controlling the fracture toughness in the zone 16 is to mix or include boron with the material used to form the support structure 12 prior to the sintering.

Another manner of controlling the fracture toughness in the zone 16 is to provide a boron containing gas in the atmosphere surrounding the carbide support structure 12 during the sintering of the support structure 12.

As a result of controlling the amount of cobalt swept into the diamond layer from the carbide support structure with boron being at least in the depleted zone 16, in low cobalt alloy carbide support structures the fracture toughness or fracture resistance is particularly improved.

As previously stated, the use of boron in the area for the interface of the diamond layer 14 and carbide support structure 12 of compacts 10 appears to be most effective in improving the fracture toughness or fracture resistance in compacts where the carbide support structure 12 typically contains twelve percent to twenty percent (12%–20%) cobalt in the depleted zone 16 before any cobalt depletion has occurred. This yields a cobalt percentage of three percent to thirteen percent (3%–13%) after depletion.

In the present invention, it is preferred that the carbide substrate or support structure 12 include boron in approximately a concentration range of 200 to 700 parts per million (ppm). The present invention improves the fracture toughness in the zone 16 of the support structure 12 to help prevent cracking in the zone 16 and any crack propagation from the zone 16 either into the diamond layer 14 or support structure 12 of the compact 10.

Figure 2:
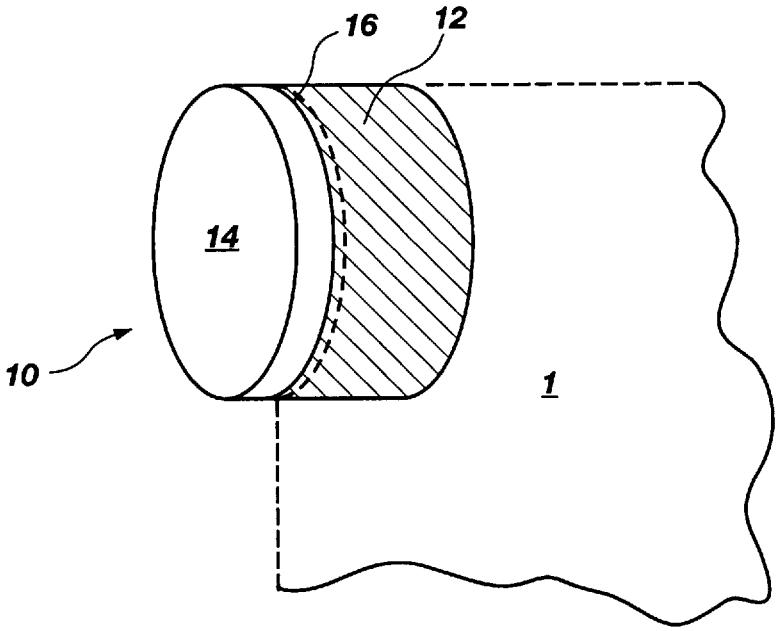
FIG. 2 illustrates the cutting element of the present invention in a portion of a drill bit.

While the present invention has been described with respect to the use of boron in the support structure 12, other materials may be used to give improved fracture toughness, such as beryllium and the like. Referring to drawing FIG. 2, the compact 10 of the present invention is shown mounted on a portion of a drill bit 1 shown in broken lines.

It will be understood by those of ordinary skill in the art that changes, modifications, deletions, and additions may be made which fall within the scope of the invention.

What is claimed is:

1. A polycrystalline compact comprising:

a carbide substrate comprising a member having a first end, first end region located adjacent the first end, a second end, and remaining region, the carbide substrate having cobalt non-uniformly dispersed therein throughout the first end region and the remaining region thereof, the first end region located adjacent the first end of the carbide substrate having less cobalt therein than the remaining region of the carbide substrate;

a polycrystalline material layer joined to the carbide substrate the polycrystalline material joined to the first end of the carbide substrate; and a quantity of boron located in the first end region located adjacent the first end of the carbide substrate joined to the polycrystalline substrate material layer thereby resulting in improved fracture toughness of said polycrystalline compact.

2. The polycrystalline compact of claim 1, wherein the carbide substrate contains a quantity of boron therein.

3. The polycrystalline compact of claim 1, wherein the polycrystalline layer comprises diamond.

4. The polycrystalline compact of claim 1, wherein the carbide substrate comprises tungsten carbide.

5. The polycrystalline compact of claim 4, wherein the carbide substrate further comprises tungsten carbide and cobalt.

6. The polycrystalline compact of claim 1, wherein the carbide substrate comprises less than seven percent cobalt.

7. The polycrystalline compact of claim 1, wherein the carbide substrate comprises less than ten percent cobalt.

8. The polycrystalline compact of claim 1, wherein the carbide substrate comprises less than twenty percent cobalt.

9. The polycrystalline compact of claim 1, wherein the carbide substrate comprises less than thirty percent cobalt.

10. The polycrystalline compact of claim 1, wherein the carbide substrate comprises approximately 200–700 ppm of boron.

11. A polycrystalline compact comprising:

a carbide substrate having cobalt therein;

a polycrystalline material layer joined to the carbide substrate; and a quantity of beryllium used in the carbide substrate during the formation thereof thereby resulting in improved fracture toughness of said polycrystalline compact.

12. A polycrystalline compact comprising:

a carbide substrate comprising a member having a first end, first end region located adjacent the first end, a second end, and remaining region, the carbide substrate having cobalt non-uniformly dispersed therein throughout the first end region and the remaining region thereof, the remaining region of the carbide substrate having more cobalt therein than the first end region of the carbide substrate;

a polycrystalline material layer joined to the carbide substrate, the polycrystalline material joined to the first end of the carbide substrate; and a quantity of boron located in the first end region located adjacent the first end of the carbide substrate joined to the polycrystalline substrate material layer thereby resulting in improved fracture toughness of said polycrystalline compact.

13. A polycrystalline compact comprising:

a carbide substrate comprising a member having a first end, first end region, second end, and remaining region, the carbide substrate having cobalt non-uniformly dispersed therein throughout the first end region and the remaining region thereof, the first end region located adjacent the first end of the carbide substrate having less cobalt therein than the remaining region of the carbide substrate;

a polycrystalline material layer joined to the carbide substrate, the polycrystalline material joined to the first end of the carbide substrate; and a quantity of beryllium located in the first end region located adjacent the first end of the carbide substrate joined to the polycrystalline substrate material layer thereby resulting in improved fracture toughness of said polycrystalline compact.

* * * * *

UNITED STATES PATENT AND TRADEMARK OFFICE

CERTIFICATE OF CORRECTION

PATENT NO. : 5,820,985
DATED : October 13, 1998
INVENTOR(S) : Jacob Chow et al.

It is certified that error appears in the above-identified patent and that said Letters Patent is hereby corrected as shown below:

On the title page, under "[56] References Cited, U.S. PATENT DOCUMENTS" add
--4,959,929 10/1990 Burnand et al.--;

On the title page, under "[56] References Cited, FOREIGN PATENT DOCUMENTS" add
--2 258 260 2/1993 United Kingdom--;

In column 1, line 43, after "Typically", insert a comma --,--;

In column 1, line 49, after "compact,", insert --and--;

In column 1, line 54, after "bodies", insert a comma --,--;

In column 1, line 55, after "is", insert a comma --,--;

In column 1, line 63, after "hardness", insert a comma --,--;

In column 1, line 63, after "features", insert a comma --,--;

UNITED STATES PATENT AND TRADEMARK OFFICE

CERTIFICATE OF CORRECTION

PATENT NO. : 5,820,985
DATED : October 13, 1998
INVENTOR(S) : Jacob Chow et al.

It is certified that error appears in the above-identified patent and that said Letters Patent is hereby corrected as shown below:

In column 2, line 34, delete "comprise", insert --comprises--;

In column 2, line 60, before "zone", insert --depleted--;

In column 2, line 63, before "zone", insert --depleted--;

In column 2, line 66, before "zone", insert --depleted--;

In column 2, line 67, before "support", insert --carbide--;

In column 3, line 7, before "zone", insert --depleted--;

In column 3, line 8, before "support", insert --carbide--;

In column 3, line 10, before "zone", insert --depleted--;

In column 3, line 12, before "support", insert --carbide--;

In column 3, line 14, after "structure", insert a comma --,--;

In column 3, line 16, after "structures", insert a comma --,--;

In column 3, line 32, before "zone", insert --depleted--;

In column 3, line 32, before "support", insert --carbide--;

In column 3, line 33, before "zone", insert --depleted--;

UNITED STATES PATENT AND TRADEMARK OFFICE

CERTIFICATE OF CORRECTION

PATENT NO. : 5,820,985
DATED : October 13, 1998
INVENTOR(S) : Jacob Chow et al.

It is certified that error appears in the above-identified patent and that said Letters Patent is hereby corrected as shown below:

In column 3, line 34, before "zone", insert --depleted--;

In column 3, line 34, before "support", insert --carbide--;

In column 3, line 37, before "support", insert --carbide--.

Signed and Sealed this

Twenty-first Day of September, 1999

*Attest:*

Q. TODD DICKINSON

*Attesting Officer*

*Acting Commissioner of Patents and Trademarks*